US005102024A

United States Patent [19]

Boersma et al.

[11] Patent Number: 5,102,024

[45] Date of Patent: Apr. 7, 1992

[54] HEADBAND FOR HOLDING FLASHLIGHTS

[76] Inventors: Timothy A. Boersma; David A. Sheets, both of P.O. Box 285, Vernalis, Calif. 95385

[21] Appl. No.: 708,855

[22] Filed: May 31, 1991

[51] Int. Cl.[5] ..... A42B 1/24; A45F 5/00

[52] U.S. Cl. ..... 224/181; 224/253

[58] Field of Search ..... 224/181, 222, 219, 245, 224/267, 250, 251, 253; 2/209.2, DIG. 6, DIG. 11; 362/191, 250

[56] References Cited

U.S. PATENT DOCUMENTS

| | | | |
|---|---|---|---|
| 3,042,797 | 7/1962 | Rubens | 224/181 X |
| 4,887,194 | 12/1989 | Fields | 224/181 X |
| 4,953,766 | 9/1990 | Cruickshank | 224/181 |

*Primary Examiner*—Henry J. Recla
*Assistant Examiner*—David J. Walczak
*Attorney, Agent, or Firm*—Basil Travis

[57] ABSTRACT

An elastic fabric belt to be releasably worn on the head for retaining flashlights in one or more lateral fabric pockets which may be slidingly and transversely adjusted with respect to each other and to the belt comprises the headband of the present invention.

2 Claims, 1 Drawing Sheet

HEADBAND FOR HOLDING FLASHLIGHTS

BACKGROUND OF THE INVENTION

1. Field of the Invention

The present invention relates generally to garments which hold tools, and more particularly to headbands for holding one or more flashlights on the human head for adjustably projecting a light beam forwardly, rearwardly, or in both directions at the same time.

2. Prior Art

A review of the prior art discloses several different headbands for holding flashlights, but none provide the advantages of the present invention.

In U.S. Pat. No. 4,462,064 (1984), Schweitzer describes an elastic headband with an adhesively bonded tubular clip oriented laterally and transversely on the headband by a wedge whereby the flashlight is retained in the clip by friction and the beam from the flashlight is adjusted by moving the position of the headband. However, Schweitzer's invention does not embody means for retaining more than one flashlight thereon, nor does it provide for adjustment of light beams therefrom either forwardly or rearwardly in respect to the other.

In U.S. Pat. No. 4,508,249 (1985), Kotchy discloses a flashlight holder formed of a resilient single strap with a plurality of slots so constructed and arranged for wrapping the strap around a flashlight and also wrapping the flashlight around the wrist or forearm to project a light beam along the arm and the corresponding hand to light a working area. This invention is not suited for being worn on the head of a user.

In U.S. Pat. No. 4,718,126 (1988), Slay reveals a section of elastic material wrapped around the longitudinal axis of a strap and sewn thereon to form a hollow pucker on one side for receiving and retaining the handle of a flashlight by traverse tension of the elastic material. However, the retaining elastic material is not laterally nor transversely adjustable on the strap.

In U.S. Pat. No. 4,729,499 (1988), Martin describes a perforated elastic headband for mounting one or more flashlights on a person's head by insertion of a flashlight through two sets of holes and thereby also providing vertical adjustment of the flashlight beam. However, Martin's invention does not utilize slidingly adjustable flashlight retaining pockets which are believed to be a major improvement of the present invention.

In U.S. Pat. No. 4,797,793 (1989), Fields discloses a flashlight pocket formed by an overlap of two ends of a headband strap, joined together by stitching and leaving an open ended pocket at the overlap portion of the strap oriented in the forward position. However, the Fields' pocket is neither slidingly nor transversely adjustable with respect to the headband strap.

Accordingly, it is the general object of the present invention to provide a headband for retaining one or more flashlights in lateral pockets which are slidingly and transversely adjustable on the headband belt.

It is a further object of the present invention to provide adjustable flashlight retaining fabric pockets for both forward and rearward orientation of flashlights on a variety of headband belts.

It is yet a further object of the present invention to provide adjustable flashlight retaining fabric pockets for use on headband belts which are either worn on or in conjunction with a variety of head protective gear.

These and other objects of the present invention are achieved in the following specification and appended claims.

SUMMARY OF THE INVENTION

In response to a demonstrative need for a flashlight retaining headband which retains one or more flashlights thereon while also providing both lateral and vertical adjustment of either in a forward or rearward direction of one in respect to the other, the present invention comprises a releasably fastening elastic belt to be worn around the human head, headgear or in conjunction with headgear, where on the said belt there is slidingly mounted one or more fabric pockets for retaining generally cylindrical flashlight handles. Each pocket is made of a narrow fabric strip on which are sewn on one side two smaller fabric strips forming a bifurcated sleeve for folding together at the proximate center of the larger fabric strip. The flatter sleeve forms a sheath for mounting slidingly on the belt, while the larger tapered sleeve increases in width towards the opposite direction of the pocket to receive the handle of a flashlight. The flashlight retaining pocket may also contain an elastic inner liner to tightly grip the handle of a flashlight.

DESCRIPTION OF THE PREFERRED EMBODIMENT

Figure 1:
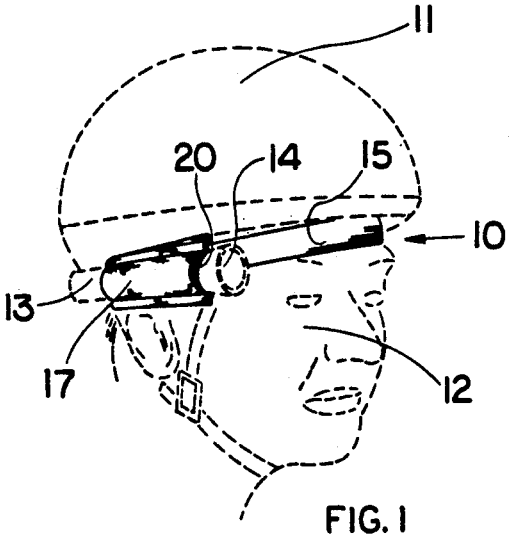
FIG. 1 is a perspective view showing the invention positioned under a bicycle helmet on a user's head.
Figure 2:
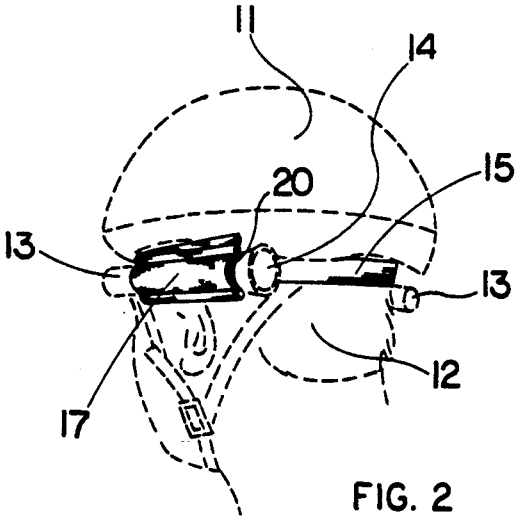
FIG. 2 is an opposite view of FIG. 1 showing the invention used for a signal light.

Referring now to FIGS. 1–2 of the drawings, the headband 10 of the present invention is illustrated being worn below a helmet 11 on the head of a user 12 above the ears, along the temples and across the forehead. A pair of flashlights 13 are shown pointing in opposite directions to illustrate one major advantage over the prior art where the presence of a user would need to be recognized from the rear by someone approaching, for example, a bicyclist at night, a construction worker or miner, or even someone making road-side repairs at night. The headbands of the prior art do not specifically address the need for a rearward signal light in conjunction with a forward illuminating light beam while a user is wearing a variety of head protection gear such as a hard hat or bicycle helmet which is a major object achieved by this invention.

The flashlights 13 illustrated in FIGS. 1–2 are those of the type sold under the trademark "MAG" as they may be commercially obtained with colored lenses 14 as a red lense for a rear signal light, however any flashlight with a relatively small-diameter handle utilizing Size AA or Size AAA batteries may also be used.

Figure 3:
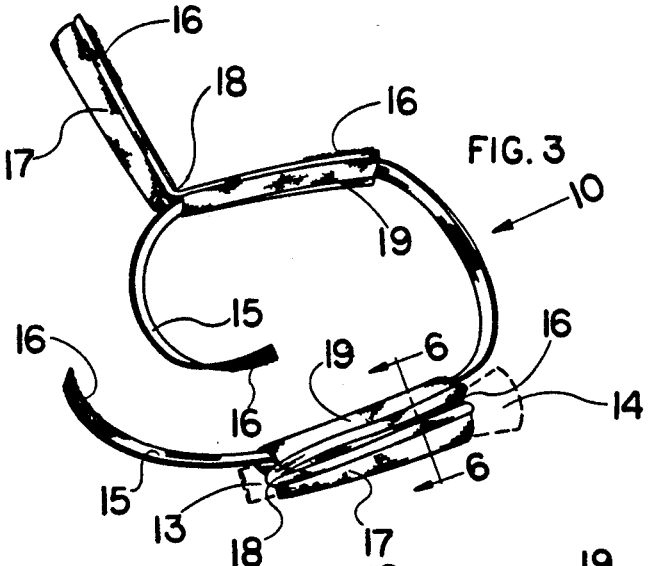
FIG. 3 is a top plan view of the invention removed from the user's head.

As illustrated in FIG. 3, the headband 10 utilizes an elastic belt 15 approximately one inch in width and of sufficient length to fit around the human head. On each end of the belt 15 are sewn mating pieces of a releasable fastener 16 of the type commonly sold under the trademark VELCRO for mounting the belt 15 on a range of different head sizes. The pockets 17 which receive the handles of flashlights are connected by a fold 18 in the fabric at one end of the pocket 17 to a sheath 19 whereby the fold 18 serves as a hinge for transverse positioning of the opposite end of the pocket 17 which is made possible by pieces of mating releasable fasteners 16 sewn on the sheath 19 and pocket 17. The sheath 19 slidingly engages the circumference of the belt 15 so that one pocket 17 may be laterally adjusted with respect to the other pocket 17, or the sheath 19 may also be oppositely oriented on the belt 15 by merely turning it upside down so that the pocket 17 will face in a rearward direction as illustrated in FIG. 2.

Since the belt 15 basically serves the same function as the well-known "strap" in prior art headbands, it is believed that the pocket 17 is the major improvement of the present invention over the prior art because the pocket 17 may be used with a variety of belts, straps or narrow strips of fabric which may slidingly receive the sheath 19. Therefore, the construction of the pocket 17 shall be briefly recited.

Figure 6:
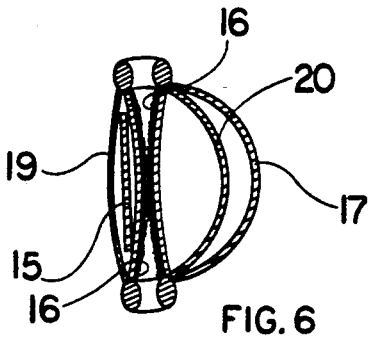
FIG. 6 is a sectional view through the pocket as seen along line 6—6 of FIG. 3.
Figure 4:
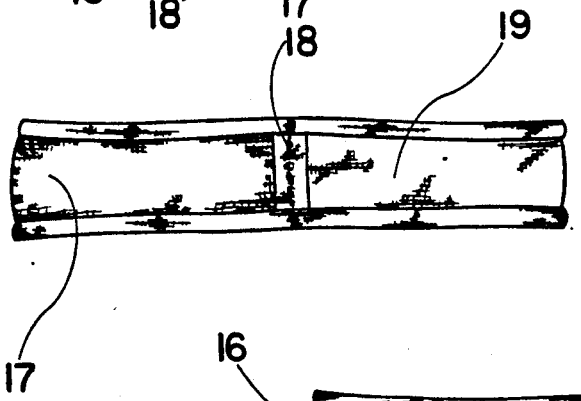
FIG. 4 is an elevational view of one pocket in an open position and removed from the belt.

Referring to FIG. 4, it can be seen that pocket 17 of the present invention is essentially made from a strip of fabric approximately eight inches long and two inches wide onto which has been sewn other fabric strips forming a bifurcated sleeve. The flatter part of the sleeve forms the sheath 19 which slidingly receives the belt 15. The larger part of the sleeve forms a tapered pocket 17 with gradual increase in width toward the front for receiving the handle of a flashlight 13. Sewn coaxially within the pocket 17 is an elastic inner liner 20, further illustrated in the cross-sectional view of FIG. 6, for tightly gripping the handle of a flashlight.

Figure 5:
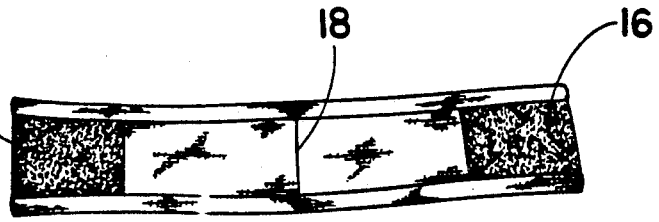
FIG. 5 is an elevational view of the side opposite that shown in FIG. 4.

Referring to FIG. 5, the reverse or rear view of FIG. 4, there is illustrated the opposite side of the pocket 17 showing the perpendicular fold 18 in the center about which the ends are releasably fastened together by hook and loop fasteners 16. The operation of the fold 18 in conjunction with positioning of the fasteners 16 together provide the means for transverse or vertical adjustment of the pocket as illustrated in FIG. 3.

Having described our invention, we claim:

1. On a headband having at least one pocket positioned on a belt worn around a user's head for retaining a generally cylindrical flashlight in said pocket, the improvement comprising:

said pocket being made of fabric and laterally slidingly and traversely adjustable on said belt, each of said pockets connected at one end thereof to a fabric sheath which circumferentially engages said headband belt, the interconnection of said pocket and said sheath comprising a fold, said pocket further including hook and loop release fastening means thereon at an end opposite said fold and said sheath including cooperating hook and loop release fastening means on an end opposite said fold for vertical positioning of said pocket on said headband belt for angular orientation of a flashlight with respect to said belt.

2. An improved flashlight retaining pocket of claim 1 wherein said pocket contains an inner liner of elastic material to tightly grip a handle of a flashlight.

* * * * *